US005802860A

United States Patent [19]

Barrows

[11] Patent Number: 5,802,860

[45] Date of Patent: Sep. 8, 1998

[54] REFRIGERATION SYSTEM

[75] Inventor: Richard C. Barrows, South Bend, Ind.

[73] Assignee: Tyler Refrigeration Corporation, Niles, Mich.

[21] Appl. No.: 843,097

[22] Filed: Apr. 25, 1997

[51] Int. Cl.[6] ..... F25B 41/00; F25B 49/00

[52] U.S. Cl. ..... 62/126; 62/197; 62/513

[58] Field of Search ..... 62/197, DIG. 17, 62/513, 179, 126

[56] References Cited

U.S. PATENT DOCUMENTS 4,831,835 5/1989 Beehler et al. ..... 62/196.1
5,070,705 12/1991 Goodson ..... 62/197

FOREIGN PATENT DOCUMENTS 0263051 10/1990 Japan ..... 62/197

*Primary Examiner*—William E. Wayner
*Attorney, Agent, or Firm*—Baker & Daniels

[57] ABSTRACT

A refrigeration system which controls subcooling by controlling the amount of refrigerant diverted from the condenser to the receiver based upon the difference in temperature between the phase change transition temperature of the refrigerant in the condenser and the liquid refrigerant temperature at the condenser output. Refrigerant is bled from the receiver to charge the system until the condenser pressure causes the difference between the phase change and liquid temperatures to exceed a predetermined value. A controller responds to this condition by simultaneously operating a bleed valve at the receiver inlet and a release valve at its outlet to draw refrigerant from the condenser into the receiver. As the condenser pressure drops, the difference between the phase change and liquid temperatures decreases toward the desired amount, and the cycle begins again.

16 Claims, 10 Drawing Sheets

```
/* Tyler Stand Alone Enviroguard Control Software */

#define FANCTRL


#ifdef __AVOCET__
#include "intrpt.h"
#include "atodh8.h"
#endif

#include "encore.h"
#include "structs.h"
#include "sensor.h"
#include "timers.h"
#include "memory.h"

#include "hc16atod.h"
#include "scim.h"
#include "gpt.h"
#include "evhandlr.h"
#include "events.h"
#include "commmsg.h"

#include "control.h"
#include "fanctrl.h"

schar FanOuts[MAX_FANS] = { FAN1_INDEX,      /* Array to hold fan indices */
                            FAN2_INDEX,
                            FAN3_INDEX,
                            FAN4_INDEX,
                            FAN5_INDEX,
                            FAN6_INDEX };
schar FanNumber;    /* current fan number to turn on, 1 relative, 0 == no fans */
                    /* used as an index into FanOuts */
schar ValveOn;      /* holds current state of valve for boolean purposes */

Timer UnitsToSeconds(sint Time, char Unit);

void TurnOnValveWithDelay( void )
{
   if ( ValveOn )     /* if valve already on, return */
      return;

   if ( S_CheckStarted( & Tmr5min ) )
   {
      if ( S_CheckExpired( & Tmr5min ) )
      {
         S_StopTimer( & Tmr5min );

         ValveOn = TRUE;
      }
   }
   else
   {
      S_StartTimer( & Tmr5min , UnitsToSeconds( 5, UCHAR_UNIT_MINUTES ) );
   }
}

void TurnOffValveWithNoDelay( void )
{
   S_StopTimer( & Tmr5min );
```

Fig. 4A

```
   ValveOn = FALSE;
}

void StageFansOnWithDelay( void )
{
   if ( (MAX_FANS - FanSubtract) == FanNumber )
      return;

   if ( S_CheckStarted( & Tmr2min ) )
   {
      if ( S_CheckExpired( & Tmr2min ) )
      {
         S_StopTimer( & Tmr2min );

         /*
         // Get next valid fan number to turn on
         */
         FanNumber++;
      }
   }
   else
   {
      /*
      // Allow for 0 delay when staging on #1 fan, otherwise a 2 minute delay
      */
      if ( 0 == FanNumber )
         FanNumber = 1;          /* allow Head fan to go with 0 delay */
      else
         S_StartTimer( & Tmr2min, UnitsToSeconds( 2, UCHAR_UNIT_MINUTES ) );
   }
}

void StageFansOffWithDelay( void )
{
   if ( 0 == FanNumber )
      return;

   if ( S_CheckStarted( & Tmr2min ) )
   {
      if ( S_CheckExpired( & Tmr2min ) )
      {
         S_StopTimer( & Tmr2min );

         /*
         // Get next valid fan number to turn off
         */
         FanNumber--;
      }
   }
   else
   {
      S_StartTimer( & Tmr2min, UnitsToSeconds( 2, UCHAR_UNIT_MINUTES ) );
   }
}

void InitFanControl( void )
{
   int    i;

   S_StopTimer( & Tmr24hour ); /* delay for decreasing Tb */
   S_StopTimer( & Tmr3hour );  /* delay for low charge alarm */
```

Fig.4b

```
    S_StopTimer( & Tmr1hour );  /* delay for increasing Tb */
    S_StopTimer( & Tmr10min );  /* delay for holding Tcl 10 min beyond defrost */
    S_StopTimer( & Tmr5min );   /* delay for turning valve on */
    S_StopTimer( & Tmr2min );   /* delay for staging fans ON */

    Tb = 15 * 10;      /* initialize Tb to 15 degrees */

    FanNumber = 0;     /* initialize to no fans on (FanNumber = 0) */
    ValveOn   = 0;     /* initialize valve state to off */

    AllowTbDecrement = FALSE;  /* initially not allowing Tb to be decremented */

    Tdds = 180000L;          /* set up Tdds (degree-seconds counter) to 180000 */

    /*
    // Physically initiazile fans and valve to OFF state
    */
    SetOutput( & Outputs[VALVE_INDEX], OFF );       /* Valve Closed */
    for ( i = 0; i < (MAX_FANS - FanSubtract); i++ )
       SetOutput( & Outputs[ FanOuts[i] ], OFF );   /* Fans Off */

    /*
    // upon Rich Barrows' request, start 24 hour timer upon initialization
    */
    S_StartTimer( & Tmr24hour, UnitsToSeconds( 24, UCHAR_UNIT_HOURS ) );
}

void CheckTbRange( void )
{
    /* Decrement Tb with limit of 5 */
    if ( Tb < 5 * 10 )
       Tb = 5 * 10;

    /* Increment Tb with limit of 25 */
    if ( Tb > 25 * 10 )
       Tb = 25 * 10;

    /* Do some Tb checking based on Elrc's length */
    if ( Elrc < 10 && Tb < 10 * 10 )
       Tb = 10 * 10;
}

void FanControl( void )
{
    uchar i;
    uchar fail_count = 0;

    /*
    // Check for Fail-Safe conditions
    */
         if ( Sensors[Tl_INDEX].AlarmFlags.Bits.BadSensor   &&
              Sensors[Ta_INDEX].AlarmFlags.Bits.BadSensor      )
    {
       fail_count = 2;
    }
         else if (Sensors[Ta_INDEX].AlarmFlags.Bits.BadSensor)
    {
       Ta = Tl - 60;       /* Ta = Tl - 6 degrees */
       fail_count ++;
    }
         else if (Sensors[Tl_INDEX].AlarmFlags.Bits.BadSensor)
    {
```

Fig.4C

```
   Tl = Ta + 60;       /* Ta = Tl + 6 degrees */
   fail_count ++;
}
     if (Sensors[Pl_INDEX].AlarmFlags.Bits.BadSensor)
{
   fail_count = 3;     /* definite failure condition */
}

if ( fail_count >= 2 )
{
   SetOutput( & Outputs[VALVE_INDEX], OFF );       /* Valve Closed */
   for ( i = 0; i < (MAX_FANS - FanSubtract); i++ )
      SetOutput( & Outputs[ FanOuts[i] ], ON );    /* Fans On */

   return;
}

if ( Sensors[Tcl_INDEX].AlarmFlags.Bits.BadSensor  &&
     ControlFlags.Bits.TclOption                        )
{
   Tmin = 600;     /* use 60 degree selection for Tmin */
}


/*
// Step 1 in flow chart groupings
//
// Change Tb if (Tl - Ta) > 5 and appropriate timers have expired
//
// Calculate Tdds (dgree-second count) = (Tdds - Tdds/3600) + (Tl - Ta).
// If Tdds > 180,000 then (Tl - Ta) > 5 degrees for some time, otherwise
// it is less than 5 degrees and will not climb above 180,000
//
*/
Tdds = ( Tdds - (Tdds / 3600L) ) + (slong)(Tl - Ta);

/*
// Place some restrictions on Tdds
*/
if ( Tdds < 0L )
   Tdds = 0L;
if ( Tdds > 360000L )
   Tdds = 360000L;

if ( S_CheckStarted( & Tmr24hour ) )
{
   if ( S_CheckExpired( & Tmr24hour ) )
   {
      if ( AllowTbDecrement )
         Tb -= 10;       /* decrement Tb by 1 degree */

      /* restart 24 hour timer for decreasing Tb */
      S_StartTimer( & Tmr24hour, UnitsToSeconds( 24, UCHAR_UNIT_HOURS ) );
   }
}

/*
// Tdds >= 180000 if (Tl - Ta) > 5 degrees for an hour
*/
if ( Tdds > 180000L )            /* if ( (Tl - Ta) > 5 * 10 ) */
{
   if ( S_CheckStarted( & Tmrlhour ) )
```

Fig. 4d

```
    {
       if ( S_CheckExpired( & Tmr1hour ) )
       {
          Tb += 10;      /* Increment Tb by 1 degree */

          /* restart 1 hour timer for changing Tb */
          S_StartTimer( & Tmr1hour , UnitsToSeconds( 1, UCHAR_UNIT_HOURS ) );

          /* restart 24 hour timer for decreasing Tb */
          S_StartTimer( & Tmr24hour, UnitsToSeconds( 24, UCHAR_UNIT_HOURS ) );

       }
    }
    else
    {
       S_StartTimer( & Tmr1hour, UnitsToSeconds( 1, UCHAR_UNIT_HOURS ) );
    }
 }
 else
 {
    /*
    // reset timers if (Tl - Ta) < 5 * 10
    */
    S_StopTimer( & Tmr1hour );
 }

 /*
 // Make sure Tb stays at a valid degree
 */
 CheckTbRange( );

 /*
 // Step 2 in flow chart groupings
 //
 // Calculate a value for Tco
 */
 if ( ControlFlags.Bits.DefrostStatus )
 {
    Tclmin = Tclminlast;   /* use last value of Tclmin */

    /*
    // always start timer to hold Tclminlast for 10 minutes after defrost,
    // if we always start the timer, then when we are out of defrost,
    // it is already started for us
    */
    S_StartTimer( & Tmr10min, UnitsToSeconds( 10, UCHAR_UNIT_MINUTES ) );
 }
 else
 {
    /*
    // if 10 minute timer is started and not expired, then hold Tclmin
    */
    if ( S_CheckStarted( & Tmr10min ) && (! S_CheckExpired( & Tmr10min )) )
    {
       Tclmin = Tclminlast;   /* use last value of Tclmin */
    }
    else
    {
       /*
       // Calculate actual value for Tclmin
       */
       Tclmin = Tcl - (Elclc / 4) + 3;
```

Fig. 4E

```
      Tclminlast = Tclmin;        /* update for next defrost */
      S_StopTimer( & Tmr10min ); /* stop & reset 10 minute defrost timer */
   }
}

Tco    = max( Tmin, max( Ta + Tb, Tclmin ) );

/*
// Allow Tb to be decremented only if (Ta + Tb) is used for Tco
*/
AllowTbDecrement = FALSE;
if ( Tco == (Ta + Tb) )
   AllowTbDecrement = TRUE;

/*
// Step 3 in flow chart groupings
//
// Calculate a value for Tc via a Lookup Table
//
// Actually, this is done in control.c during ReadInputs()
//
*/
/* Pc = Pl - (Elrc / 2); */
/* Tc = LookupPT( Pc ); */

/*
// Step 4 in flow chart groupings
//
// Calculate a value for Top, then use Top and Tc to turn on Valves
*/
Top = Tco + (Tl - Ta) + Tos;

if ( Tc > Top )
{
   TurnOnValveWithDelay();
}
else if ( Tc < Top )
{
   TurnOffValveWithNoDelay();
}
else
{
   /*
   // Stop and reset timer associated with valve on/off
   */
   S_StopTimer( & Tmr5min );
}

/*
// Step 5 in flow chart groupings
//
// Calculate a value for Tci
*/
Tci = Tco + 5 * 10;    /* Tci is 5 degrees above Tco */

/*
// Step 6 in flow chart groupings
//
// Stage fans on or off based on Tc, Tci (cut in), and Tco (cout out)
*/
if ( Tc > Tci )
```

Fig. 4F

```
{
   StageFansOnWithDelay();
}
else if ( Tc < Tco )
{
   StageFansOffWithDelay();
}
else
{
   /*
   // Stop and reset timer associated with fan cut in/out
   */
   S_StopTimer( & Tmr2min );
}

/*
// change states of fans and valves based on FanNumber and ValveOn
//
// also, change status of 3 hour valve timer depending on valve state
*/
if ( ValveOn )
{
   /* if valve is Open, (contacts closed), reset (stop) timer */
   S_StopTimer( & Tmr3hour );
}
else
{
   /*
   // Valve is Closed, (contacts open), better not stay this way for 3 hrs
   */
   if ( ! S_CheckStarted( & Tmr3hour ) )
      S_StartTimer( & Tmr3hour , UnitsToSeconds( 3, UCHAR_UNIT_HOURS ) );
}
SetOutput( & Outputs[VALVE_INDEX], ValveOn );
for ( i = 1; i <= (MAX_FANS - FanSubtract); i++ )
{
   if ( i <= FanNumber )
      SetOutput( & Outputs[ FanOuts[i-1] ], ON );
   else
      SetOutput( & Outputs[ FanOuts[i-1] ], OFF );
```

Fig. 4G

REFRIGERATION SYSTEM

REFRIGERATION SYSTEM

The present invention relates generally to refrigeration systems and specifically to an electronically controlled commercial refrigeration system capable of achieving a desired level of refrigerant subcooling over a range of operating conditions.

IDENTIFICATION OF COPYRIGHT

A portion of the disclosure of this patent document contains material which is subject to copyright protection. The copyright owner has no objection to the facsimile reproduction by anyone of the patent document or the patent disclosure as it appears in the Patent and Trademark Office issued patent file or records, but otherwise reserves all copyright rights whatsoever.

BACKGROUND OF THE INVENTION

The condenser of many commercial refrigeration systems is located on the roof top of the installation site to facilitate heat transfer from the refrigerant flowing through the condenser coils to the ambient atmosphere. The cooled refrigerant then flows from the condenser to the expansion valves at the refrigeration cases. It is known to include a receiver in the system to accept a portion of the refrigerant expelled from the outlet of the condenser. The receiver permits the refrigerant to separate into gas and liquid components according to commonly known principles. Some conventional systems, such as that taught in U.S. Pat. No. 4,831,835 issued to Beehler et al., direct the liquid refrigerant from the receiver to the expansion valves. This is intended to increase the system capacity as liquid refrigerant absorbs more heat in the evaporator than a mixture of liquid and gaseous refrigerant.

However, it is also desirable to route liquid refrigerant from the condenser directly to the expansion valves when the refrigerant has been cooled below the phase change transition temperature (i.e., "subcooled"). Subcooling is most easily achieved when the condenser is exposed to low ambient air temperatures. The system described in Beehler et al. proposes to selectively bypass the receiver based upon the refrigerant temperature at the condenser output. When the temperature is below a predetermined value indicating a desired level of subcooling, the refrigerant is routed directly to the expansion valves. When the temperature is above the predetermined value, the refrigerant is routed to the receiver which, in turn, passes liquid refrigerant to the expansion valves.

Systems such as Beehler et al., however, are unable to ensure the passage of subcooled refrigerant to the expansion valves during warm ambient air conditions. Also, because of the manner in which refrigerant is introduced into the receiver, such prior art conventional systems typically operate at relatively high refrigerant pressure within the condenser. Thus, the system compressors must work correspondingly harder, thereby consuming greater electrical energy.

Other conventional refrigeration systems, such as that described in U.S. Pat. No. 5,070,705 issued to Goodson et al., address the inadequate subcooling provided by selective bypass systems by removing the receiver from the direct flow path to the expansion valves and by controlling the flow of refrigerant to the receiver. A dynamic regulating valve at the input of the receiver operates based upon the differential between the saturation pressure corresponding to ambient air conditions and the pressure of the liquid refrigerant from the condenser at the input of the valve. In addition, a metering device is provided in communication with the receiver to return refrigerant to the system when necessary. As such, liquid, and often subcooled, refrigerant is normally provided from the condenser to the expansion valves. However, refrigerant may still be diverted to the receiver when inadequate subcooling is present, since it is not sensed.

SUMMARY OF THE INVENTION

The present invention is a commercial refrigeration system which provides continuous subcooling by controlling the flow of refrigerant from the condenser to the receiver to adjust the pressure within the condenser, thereby ensuring that the difference between the phase change transition temperature of the refrigerant within the condenser and the temperature of the refrigerant outputted from the condenser remains at a desirable level of subcooling. Normally, refrigerant from the condenser is cooled to a temperature slightly above the ambient outside temperature and routed to the expansion valves at the refrigeration cases. The refrigerant is thereafter compressed and returned to the condenser. The receiver, which is out of the flow path to the expansion valves, continuously bleeds relatively small amounts of refrigerant through a liquid bleed circuit to the suction side of the compressors. This refrigerant eventually results in a pressure build up in the condenser. As the pressure increases, the corresponding phase change or condensing temperature increases. However, the actual temperature of the liquid refrigerant leaving the condenser tends to decrease because of the heat transfer characteristics of the system when there is a greater quantity of refrigerant in the condenser. Obviously, as the phase change temperature increases and the liquid temperature decreases, the temperature differential between the two (i.e., the level of subcooling) increases.

As the receiver continues to bleed refrigerant to the system, the condenser pressure approaches an undesirably high level. The system employs an electronic controller to detect this condition by reading signals from sensors which represent the phase change and actual liquid temperatures. When the temperature difference between these variables exceeds a target value, the controller decreases the pressure within the condenser by simultaneously opening a bleed valve at the receiver input (fed by the condenser output) and a vapor valve at the receiver output (connected to the suction side of the compressors). By operating these valves in unison, the system ensures that the receiver pressure will be sufficiently low relative to the condenser output pressure to allow refrigerant flow into the receiver through the bleed valve. The reduced volume of liquid refrigerant in the condenser consequently corresponds to a lower phase change temperature and a higher actual liquid temperature at the output of the condenser. Thus, the temperature difference between the phase change temperature and the liquid temperature decreases to within acceptable limits and the continuous build up of pressure begins again.

This control scheme maintains a relatively constant level of subcooling during warmer ambient outdoor conditions while much of the time resulting in lower condenser operating pressures than are present in conventional systems, and correspondingly lower loading on the compressors. Additionally, the total volume of refrigerant required for a system with a given refrigeration capacity is substantially reduced from that required for many conventional systems. Reduced demand for refrigerant is advantageous since many types of refrigerant are known to be potentially harmful to the environment.

The system also permits early leak detection by monitoring the time lapse between valve operations, further protecting the environment and preventing loss of product from inadequate refrigeration. Absent a leak, the cycle of condenser pressure build up and subsequent bleed and vapor valve operation repeats according to a substantially predictable schedule. When a leak in the system develops, the elapsed time between valve operations eventually increases since refrigerant is continuously lost through the leak. When the elapsed time exceeds a predetermined maximum, the controller enables a leak alarm to notify an operator.

In another embodiment of the present invention, the controller software recognizes conditions which correspond to relatively cold outdoor ambient temperatures. Under these conditions and due to minimum condensing temperature limits, the ambient temperature may be substantially lower than the phase change temperature of the refrigerant, even at relatively low condenser pressures. The system of this invention exploits the improved subcooling made available by the cold ambient temperatures by increasing the target subcooling temperature. The phase change temperature also falls when ambient temperatures are low, but is limited by the controller to a minimum value corresponding to a minimum required pressure differential, for example, across the compressors. The system thus permits the actual liquid temperature to fall below this minimum phase change temperature by an amount exceeding that which would otherwise constitute the target subcooling value.

In yet another embodiment, the controller also controls the operation of roof top fans mounted adjacent the condenser to direct ambient air across the condenser coils. The controller sequentially enables or disables fans to affect, in cooperation with the valves at the inlet and outlet of the receiver, the differential between the phase change temperature and the condenser ambient air temperature. The controller compares measurements of the ambient outdoor air temperature to the temperature of the liquid refrigerant from the condenser. The system controls the condenser pressure according to a software algorithm by opening the bleed and vapor valves when the difference between the ambient and liquid temperatures is relatively small, and by enabling a fan when the difference is relatively large.

In still another embodiment of the present invention, the controller employs a software routine which tends to optimize subcooling by adjusting the target subcooling value based upon measurements of recent system performance. When the liquid refrigerant temperature from the condenser remains sufficiently above the ambient temperature for a sufficiently long period of time, the software increases the target subcooling number by one unit. This increase, which ultimately corresponds to increased liquid refrigerant within the condenser, tends to reduce the liquid temperature toward ambient. If, on the other hand, the liquid temperature remains sufficiently close to the ambient temperature for a predetermined period of time, the target subcooling number is decreased by one unit.

Accordingly, it is an object of the present invention to provide a refrigeration system wherein refrigerant subcooling is achieved during warm ambient conditions.

It is another object of the invention to provide a refrigeration system which provides superior refrigeration while maintaining low refrigerant pressure within the compressor, thereby conserving electrical energy.

Another object of the invention is to provide a refrigeration system which provides early detection of refrigerant leaks.

Yet another object of the invention is to provide a refrigeration system which dynamically optimizes refrigerant subcooling based upon system performance and operating conditions.

Another object of the present invention is to provide a refrigeration system which controls refrigerant subcooling by dynamically controlling the condenser fans and the valving which diverts refrigerant to the receiver.

Still another object of the invention is to provide a refrigeration system which minimizes the volume of refrigerant required for a desired refrigeration capacity.

BRIEF DESCRIPTION OF THE DRAWINGS

The above-mentioned and other objects of the present invention, and the manner of attaining them, will become more apparent and the invention itself will be better understood by reference to the following description of the invention taken in conjunction with the accompanying drawings, wherein:

FIG. 4*a*–4*g* are computer printouts of source code representing an embodiment of the software of the present invention.

DESCRIPTION OF THE INVENTION

The preferred embodiments disclosed below are not intended to be exhaustive or to limit the invention to the precise forms disclosed. Rather, the embodiments are chosen and described so that others skilled in the art may utilize their teachings.

Figure 1:
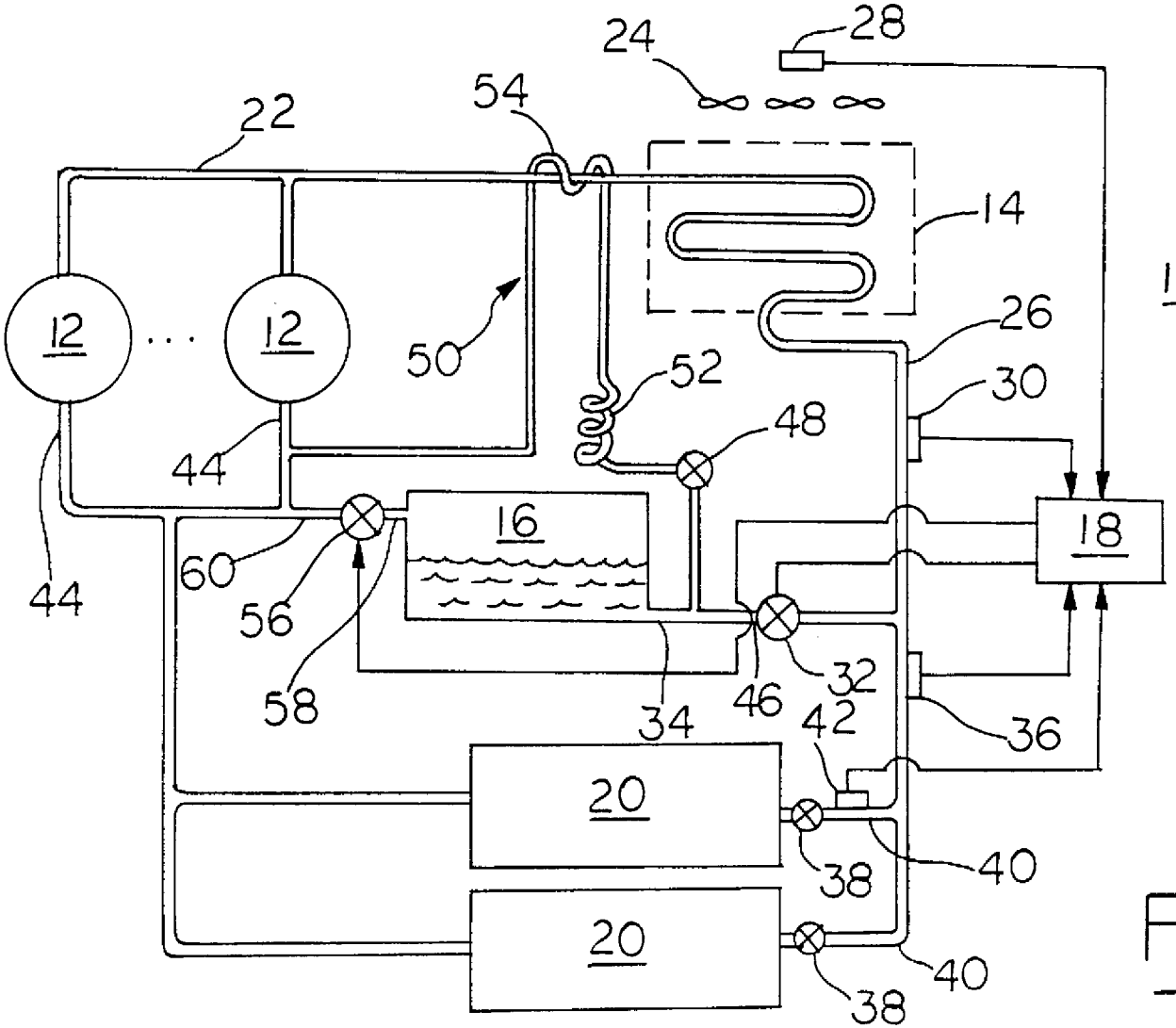
FIG. 1 is a schematic view of the refrigeration system of the present invention.

FIG. 1 shows a refrigeration system 10 having multiple compressors 12, a condenser 14, a receiver 16, a controller card 18, multiple refrigeration cases 20, and a plurality of valves and sensors. Compressors 12 are plumbed in flow communication to supply compressed gaseous refrigerant through line 22 to condenser 14. Condenser 14 is typically remotely located on a rooftop. A plurality of fans 24 are disposed adjacent condenser 14 to create a stream of ambient temperature air across the coils of condenser 14 to provide cooling of the refrigerant circulating therethrough. A temperature sensor 28 measures the ambient air temperature ($T_{AMBIENT}$) and sends a signal representative of $T_{AMBIENT}$ to controller card 18. The cooled refrigerant is delivered to the drop leg or liquid line 26 at the output of condenser 14.

An additional temperature sensor 30 is disposed in relation to liquid line 26 to sense the temperature of the liquid refrigerant discharged from condenser 14 ($T_{LIQUID}$) and provide a signal representing $T_{LIQUID}$ to controller card 18. Refrigerant directed through liquid line 26, which flows to refrigeration cases 20, may also flow through a bleed valve 32 at the inlet 34 of receiver 16 depending upon the subcooled condition of the refrigerant. A pressure sensor 36 is connected to liquid line 26 to measure the pressure of the liquid at the compressor rack (not shown). Pressure sensor 36 provides a pressure signal ($P_{LIQUID}$) to controller card 18. Controller card 18 approximates the pressure at condenser 14 using $P_{LIQUID}$ and uses a look-up table to determine, given the type of refrigerant, the saturation or condensing temperature of the refrigerant at that approximated pressure. This condensing temperature ($T_{COND}$) represents the temperature at which the refrigerant changes phase in condenser 14, as will be described later in further detail. Controller card 18, temperature sensor 30, and pressure sensor 36 thus comprise a control means for determining whether the refrigerant is sufficiently subcooled according to control parameters stored in the memory of controller card 18.

An expansion valve 38 (or a similar device) is disposed in flow communication with each refrigeration case supply line 40. A temperature sensor 42 for measuring the temperature of the refrigerant at refrigeration cases 20 ($T_{CASE}$) is mounted adjacent the input of an expansion valve 38. Temperature sensor 42 provides a $T_{CASE}$ signal to controller card 18 which uses it in conjunction with the $T_{COND}$ to ensure a solid column of refrigerant to refrigeration cases 20. Gaseous refrigerant from refrigeration cases 20 is directed to the suction side 44 of compressors 12 in the standard manner.

The output side 46 of bleed valve 32 is connected to receiver 16 and a valve 48 which is preferably continuously opened whenever a compressor is in operation. Valve 48 supplies liquid refrigerant into to a liquid bleed circuit 50 which includes an expansion device 52, such as capillary tubing, and an evaporating coil 54 which feeds into suction side 44 of compressors 12. A vapor valve 56 is connected to the vapor outlet 58 of receiver 16. Outlet 58 is disposed above the maximum expected liquid refrigerant level in the receiver. The output line 60 of vapor valve 56 is connected to suction side 44 of compressors 12. Both bleed valve 32 and vapor valve 56 are connected to and controlled by controller card 18. As such, both valves are preferably electronically operated solenoid valves.

Various shut off valves (not shown), are preferably disposed throughout the plumbing of system 10. These valves are typically manually operated to stop refrigerant flow at selected locations to permit isolation of various system components for maintenance or replacement. The location and appropriate use of such shut off valves is well known in the art.

As should be apparent to one skilled in the art, system 10 could readily be implemented using multiple condensers 14 of various sizes in combination as are necessary to supply adequate refrigeration for a particular installation. Additionally apparent is the use of various sizes and quantities of compressors 12 to provide the appropriate refrigerant compression for a particular site. Such compressors may be reciprocating piston compressors, or scroll or screw compressors. These system variations are not discussed in detail, as such discussion is not believed to be necessary to a full and complete understanding of the operation of the present invention.

Figure 2:
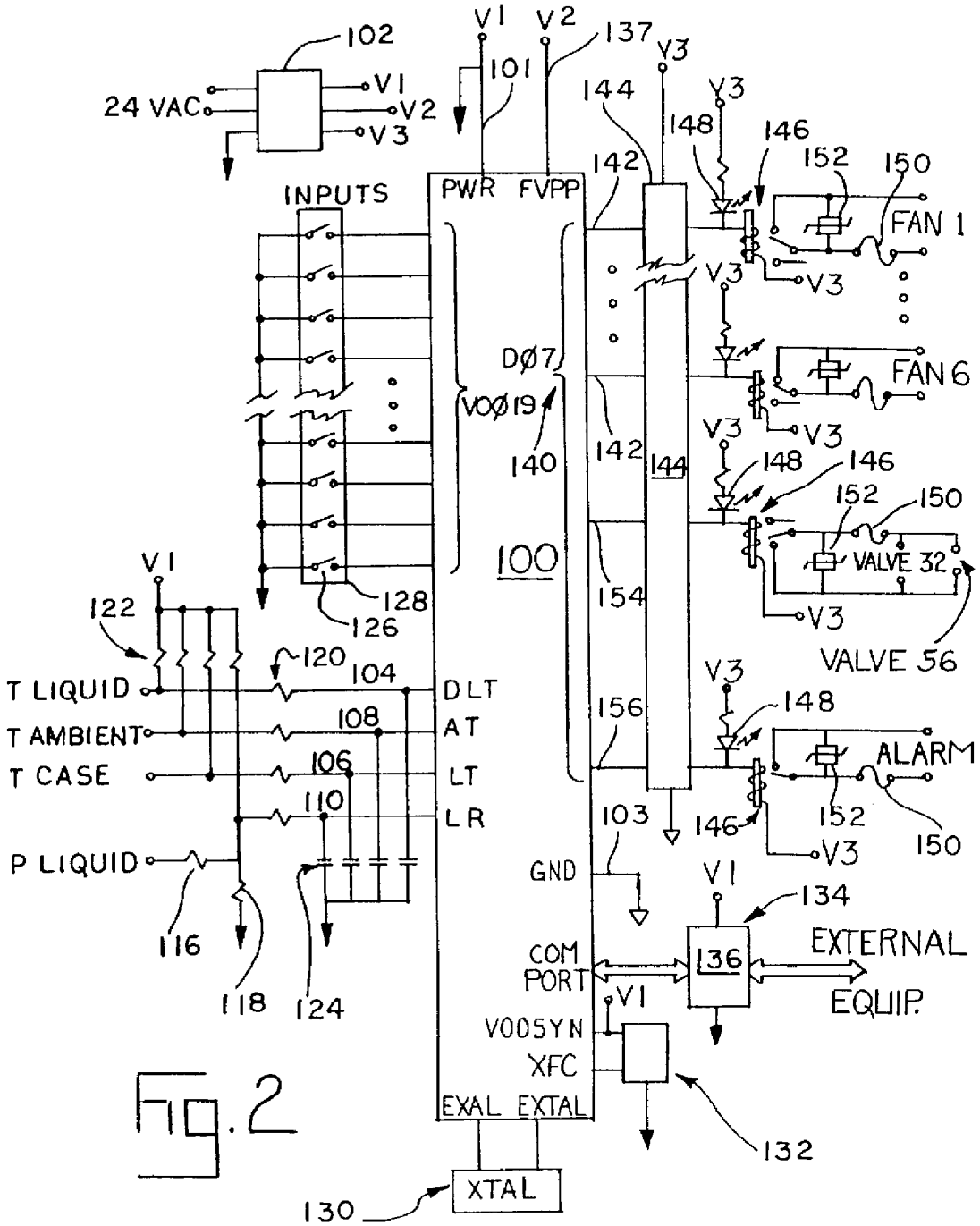
FIG. 2 is a schematic representation of the control electronics of the system shown in FIG. 1.

FIG. 2 is a schematic diagram depicting the control electronics of controller card 18. Controller card 18 includes a microcontroller 100, which is substantially embodied in a 68000 series, 16 bit programmable device from Motorola having random-access and read-only internal memory, direct I/O ports and bearing the part number MC68HC916XlCTH16. The software described herein and represented in FIGS. 3 and 4*a*–4*g* is loaded into microcontroller 100 memory (not shown) in the conventional manner. Power input 101 and ground input 103 are connected to a power supply regulating and conditioning circuit shown as block 102 in FIG. 2. Power input 101 is decoupled in the standard manner. Block 102 is connected to ground and 24 volt AC power from an external supply. Block 102 converts these signals to V1 (5 Vdc), V2 (12 Vdc), and V3 (13.5 Vdc) for supply to the components of controller card 18 in a manner commonly known in the art.

Additional circuitry external to microcontroller 100 includes a standard crystal oscillator circuit shown generally as block 130, a commonly known start-up circuit shown generally as block 132, a standard watchdog reset circuit (not shown), and a standard communication circuit 134. Communication circuit 134 is provided to facilitate testing or communications with other equipment via conventional protocol using line driver 136 in a manner commonly known to those skilled in the art. Fvpp 137 is connected to V2 for programming purposes.

User inputs UO0-19 are provided by manually setting switches 126 of switch block 128. The input to each switch is connected to ground and the output is connected to an internally pulled-up input pin on microcontroller 100. Microcontroller 100 recognizes predetermined groupings of these switches and interprets the low or high position of each switch or group of switches as binary data input. The switches are configured to permit the operator to input, for example, the column height from liquid pressure sensor 36 to condenser 14, the column height from case temperature sensor 40 to condenser 14, the refrigerant type, the minimum condensing pressure, and various other optional settings.

In addition to the user provided inputs from switch block 128, microcontroller 100 receives the $T_{LIQUID}$ signal from temperature sensor 30, the $T_{CASE}$ signal from temperature sensor 42, the $T_{AMBIENT}$ signal from temperature sensor 28, and the $P_{LIQUID}$ signal from pressure sensor 36 which is related to $T_{COND}$as described herein. $T_{LIQUID}$, $T_{CASE}$, $T_{AMBIENT}$, and $P_{LIQUID}$ are connected to inputs 104, 106, 108, and 110 respectively. Input 110 is connected to a voltage divider circuit consisting of resistor 116 and resistor 118 which reduce input 110 voltage by a factor of approximately 0.75, thereby permitting use of a variety of pressure transducers for pressure sensor 36. The output of the voltage divider and the remaining inputs 104, 106, and 108 are routed through line resistors 120 to their respective input pins on microcontroller 100. The input side of each line resistor 120 is pulled up through a resistor 122 to V1. The output side of each line resistor 120 is connected through a filter capacitor 124 to ground.

Microcontroller 100 provides output signals to fans 24 mounted adjacent condenser 14, an alarm, and bleed valve 32 and vapor valve 56 from output port 140. Each fan output signal 142 is routed to a line driver 144 which activates a corresponding relay 146. Additionally, an LED 148 may be activated to indicate the active status of the particular fan. Each relay 146, when activated, enables its connected fan 24. As is commonly known in the art, an in-line fuse 150 is provided for each fan 24 and a bi-directional zener or snubber device 152 is connected across the fan connections for noise reduction. The microcontroller of FIG. 2 is shown configured to control the plurality fans 24 (only two shown).

The alarm enable signal 156 is connected to the system alarm (not shown) in a substantially similar manner, employing line driver 144, relay 146, indicator LED 148, fuse 150, and snubber 152. The valve control signal 154 includes like components, however, the connections to bleed valve 32 and vapor valve 56 are wired to the opposite relay poll (normally opened).

Figure 3:
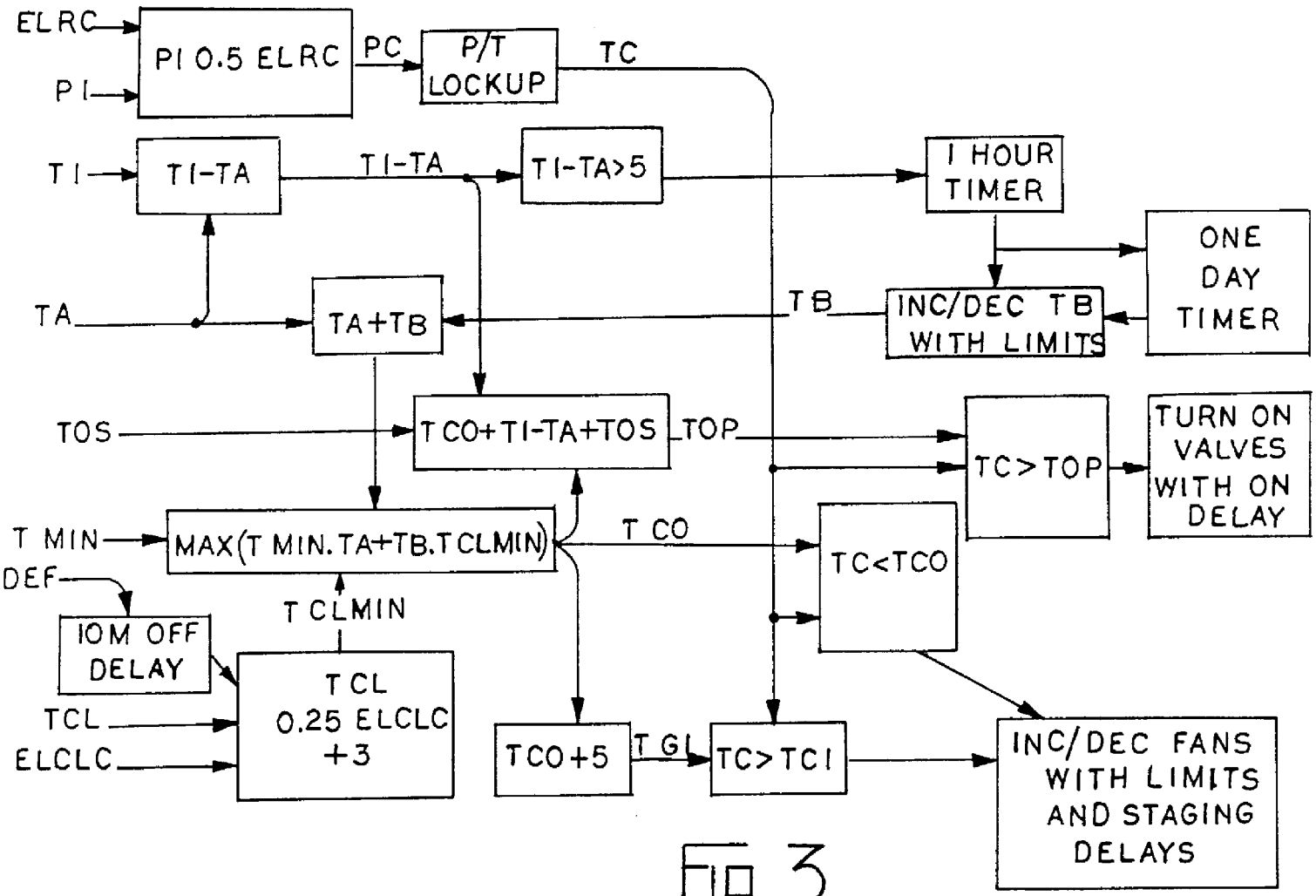
FIG. 3 is a block diagram of software operations performed by the present invention.

The block diagram of FIG. 3 is representative of the calculations performed by microcontroller 100 during the course of executing the program listed in FIGS. 4*a*–4*g*. As such, the program of FIGS. 4*a*–4*g* will be better understood by reference to the operational flow depicted in FIG. 3. The variables used in FIG. 3 correspond to variables or other parameters as follows:

Pl=$P_{LIQUID}$=pressure of liquid refrigerant as measured by sensor 36;

Pc=calculated condensing pressure;

Ta=$T_{AMBIENT}$=ambient temperature at condenser 14;

Tc=$T_{COND}$=phase change temperature of refrigerant within condenser 14;

P/T Lookup=lookup table for determining the condensing temperature of the refrigerant given its condensing pressure;

Tcl=$T_{CASE}$=refrigerant temperature measured at cases 20 by sensor 42;

Tb=$T_{TAR\text{-}DEL}$=target delta temperature;

Tl=$T_{LIQUID}$=refrigerant temperature at output of condenser 14;

inc/dec=increase or decrease;

Tmin=$T_{MIN}$=system minimum condensing temperature;

Tco=fan cut out temperature;

Tci=fan cut in temperature;

Elrc=elevation of condenser 14 relative to sensor 36;

Elclc=elevation from sensor 42 to condenser 14;

Tclmin=derived minimum refrigerant temperature at cases 20;

Tos=computational offset imposed between the fan and valve operating points; and Def=case 20 defrost signal.

Mode of Operation

The operation of system 10 is influenced in part by outdoor ambient temperatures since condenser 14 is typically located on a roof top. Controller card 18 responds to changes in $T_{AMBIENT}$, and any resulting changes in $T_{COND}$, $T_{LIQUID}$, and in an alternate embodiment, $T_{CASE}$, by adjusting the flow characteristics of the refrigerant within the system. System 10 operates in general to maintain a temperature differential between the phase change temperature of the refrigerant at condenser 14 output ($T_{COND}$) and the actual temperature of the liquid refrigerant delivered from condenser 14 ($T_{LIQUID}$). $T_{LIQUID}$ is measured directly by temperature sensor 30 mounted in operable association with liquid line 26. Pressure sensor 36 indirectly measures $T_{COND}$. Typically, sensor 36 is mounted inside the installation building in operable association with liquid line 26 at a lower elevation than the roof mounted condenser 14. Thus, the pressure of the refrigerant in liquid line 26 measured by pressure sensor 36 (below a column of liquid refrigerant from condenser 14) is greater than the pressure measured at the output of condenser 14. This offset is readily calculated and compensated for in software. At set-up, the operator simply inputs the physical parameters of system 10 using switch block 128, and the software converts the raw pressure data from pressure sensor 36 to a relatively accurate approximation of the pressure of the liquid refrigerant at condenser 14 output. The software uses this approximated condenser pressure in a pressure/temperature look-up table to determine $T_{COND}$.

System 10 controls the differential temperature (hereinafter referred to as $T_{DEL}$) between $T_{COND}$ and $T_{LIQUID}$ to ensure that it remains at a desirable value by varying the amount of refrigerant within condenser 14. In order to ensure that the gaseous refrigerant delivered to condenser 14 adequately condenses, $T_{COND}$ must always be greater than $T_{LIQUID}$. If this condition is satisfied, the refrigerant leaving condenser 14 should be substantially bubble-free, having been fully condensed into liquid. The amount by which a system cools the liquid refrigerant below the phase change temperature is commonly referred to as "subcooling." Subcooling is desirable in that subcooled refrigerant will always, of course, be in the liquid state (i.e., bubble-free) and its decreased temperature results in improved refrigeration. Conversely, if too little cooling occurs within condenser 14, then the refrigerant delivered to the rest of the system may be partially gaseous, thereby dramatically degrading the product refrigeration at refrigeration cases 20. Thus, system 10 ensures adequate subcooling and proper refrigeration by regulating $T_{DEL}$ in the following manner.

In general, liquid bleed circuit 50 continuously provides refrigerant from receiver 16 to condenser 14. Whenever any compressor 12 is operating, the pressure differential across valve 48 permits the flow of liquid refrigerant from the bottom of receiver 16. This refrigerant flows through expansion device 52 and into evaporating circuit 54 which, in an exemplary embodiment, is wrapped around the gas discharge line of compressors 12. The heat of the gas discharge line converts the liquid refrigerant to vapor which flows into suction side 44 of compressors 12 for delivery to condenser 14.

As more and more refrigerant is delivered to condenser 14, the internal pressure of condenser 14 increases. Pressure sensor 36 measures this increasing condenser pressure (albeit indirectly, as explained above), and controller 18 calculates correspondingly increasing $T_{COND}$ values. Also, as a general rule, increases in the volume of liquid refrigerant within condenser 14 result in greater heat transfer between the liquid refrigerant and condenser 14 according to commonly known principles. Consequently, $T_{LIQUID}$ tends to decrease and the amount of subcooling realized from condenser 14 increases. Thus, by continuously adding refrigerant to system 10, the pressure within condenser 14 increases, thereby increasing $T_{COND}$ and decreasing $T_{LIQUID}$. More precisely, added refrigerant increases $T_{DEL}$. Eventually, the operating $T_{DEL}$ exceeds the target temperature to which the system is controlling (hereinafter, $T_{TAR\text{-}DEL}$) and the system responds by reducing the amount of refrigerant within condenser 14.

The system varies the refrigerant level within condenser 14 by releasing refrigerant to receiver 16 when $T_{DEL}$ exceeds $T_{TAR\text{-}DEL}$. In order to ensure a solid column of liquid refrigerant between condenser 14 and cases 20, and to ensure reasonable subcooling of that liquid refrigerant, controller card 18 maintains $T_{DEL}$ at, for example, about 10° F. When $T_{DEL}$ exceeds 10° F., controller card 18 simultaneously opens bleed valve 32 to receiver 16 and vapor release valve 56 from receiver 16 to suction side 44 of compressors 12. By operating these valves in unison, controller 18 ensures that the receiver pressure is sufficiently below the refrigerant pressure at the output of condenser 14, thereby causing refrigerant to flow through bleed valve 32 into receiver 16. The reduced pressure in condenser 14 results in a decreased $T_{COND}$ value. Also, since the quantity of liquid refrigerant in condenser 14 is reduced, the heat transfer efficiency between condenser 14 and the liquid refrigerant is reduced, and $T_{LIQUID}$ tends to increase. Thus, $T_{DEL}$decreases to within the acceptable range as $T_{COND}$ and $T_{LIQUID}$ move closer together and the cycle begins again. A representative equation describing the operating temperature of the valves is $T_{OP}=T_{LIQUID}+T_{TAR\text{-}DEL}$ where $T_{OP}$ is the target condensing temperature.

During colder ambient temperatures, system 10 should, by diverting refrigerant to receiver 16 as described above, maintain lower head pressures in condenser 14 than, for example, a system without vapor release valve 56. Lower head pressures result in lower loading on compressors 12 which saves electrical energy. In some conventional systems, the pressure of receiver 16 (which is near indoor ambient temperature) drives the pressure of condenser 14 (i.e., condenser pressure is only released when receiver pressure happens to be lower). Of course, when the temperature of the ambient air blown past the roof top condenser 14 is less than the indoor ambient temperature of receiver 16, the receiver pressure will typically not be lower than the condenser pressure.

Additionally, during cold ambient outdoor temperatures, $T_{COND}$ is correspondingly low, but is limited to a minimum value ($T_{MIN}$) which may be derived from the manufacturer's minimum required pressure differential across, for example, an expansion valve of a compressor. Thus, even at relatively low ambient temperatures, $T_{COND}$ is substantially greater than $T_{AMBIENT}$. In order to take full advantage of the subcooling made possible during cold ambient conditions, an alternate embodiment of the present system permits $T_{DEL}$ to exceed 10° F. Since a 10° F. $T_{DEL}$ is possible at relatively low head pressure, greater head pressures (and correspondingly greater $T_{DEL}$) do not approach undesirable levels.

As should be apparent from the foregoing, controller card 18 must permit $T_{DEL}$ to exceed the preset 10° F. limit in order to maintain $T_{COND}$ at $T_{MIN}$, yet permit $T_{LIQUID}$ to fall substantially below $T_{MIN}$. System 10 accomplishes this by adjusting the operation of both the fans 24 mounted proximate condenser 14 and bleed and vapor valves 32,56 in communication with receiver 16. Fans 24 are used to match the condenser capacity to the condenser load near the targeted $T_{COND}$. If the load increases or decreases, $T_{COND}$ increases or decreases accordingly. If $T_{COND}$ rises to the fan cut in temperature, a fan 24 is enabled in addition to those fans, if any, that are already enabled. If $T_{COND}$ falls below the fan cut out temperature, a fan 24 is disabled. The relationship between the fan cut in temperature ($T_{CI}$), the fan cut out temperature ($T_{CO}$), and $T_{TAR\text{-}DEL}$ is described as follows:

$$T_{CO}=T_{AMBIENT}+T_{TAR\text{-}DEL},$$

$$T_{CI}=T_{CO}+5.$$

The relationship between the fan control and the valve control is complementary because both control to the same $T_{DEL}$. For computational convenience, the $T_{DEL}$ term may be factored out of the equation describing the operating point of bleed valve 32 and vapor valve 56 ($T_{OP}=T_{LIQUID}+T_{TAR\text{-}DEL}$ as explained before) and the equation describing $T_{CO}$ of fans 24 ($T_{CO}=T_{AMBIENT}+T_{TAR\text{-}DEL}$, or $T_{TAR\text{-}DEL}=T_{CO}-T_{AMBIENT}$) to yield $$T_{OP}=T_{LIQUID}+(T_{CO}-T_{AMBIENT}),$$

which may also be expressed as $$T_{OP}=T_{CO}+(T_{LIQUID}=T_{AMBIENT}).$$

Of course, the above relationships hold true regardless of the value of $T_{TAR\text{-}DEL}$.

Winter and summer conditions may be defined with respect to the minimum condensing temperature ($T_{MIN}$). In an exemplary embodiment of the software of the present invention, summertime conditions are defined as those conditions which satisfy the relationship $T_{MIN}<(T_{AMBIENT}+T_{TAR\text{-}DEL})$. So long as $T_{AMBIENT}$ plus $T_{TAR\text{-}DEL}$ remain greater than $T_{MIN}$, $T_{CO}$ equals $T_{AMBIENT}$ plus $T_{TAR\text{-}DEL}$. However, when $T_{MIN}$ is greater than $T_{AMBIENT}$ plus $T_{TAR\text{-}DEL}$ (during wintertime), $T_{CO}$ equals $T_{MIN}$. As described above, under all conditions (and regardless of $T_{DEL}$), $T_{OP}=T_{CO}+(T_{LIQUID}-T_{AMBIENT})$. The result is that both fan and valve controls use the same $T_{DEL}$ and thereby maintain their complementary performance.

According to this complementary relationship, when the difference between $T_{LIQUID}$ and $T_{AMBIENT}$ is small, system 10 tends to operate valves 32,56 to drop the condenser pressure to a level corresponding to $T_{MIN}$. When the difference between $T_{LIQUID}$ and $T_{AMBIENT}$ is relatively large, system 10 tends to enable one or more fans 24 to lower the condenser pressure. The overall effect on $T_{LIQUID}$ is that when system 10 operates the valves 32,56, $T_{LIQUID}$ increases, and when it enables fans 24, $T_{LIQUID}$ decreases.

In another embodiment of the present invention, controller card 18 incorporates a software algorithm which adjusts the amount of subcooling sought by the system in response to the system's recent historical performance during actual operation. This "adaptive subcooling" algorithm is accomplished by varying $T_{TAR\text{-}DEL}$ (i.e., $T_{OP}-T_{LIQUID}$). Controller card 18 monitors the temperature differential between $T_{AMBIENT}$ and $T_{LIQUID}$ over an extended period of time. When the average differential between these temperatures remains above a predetermined amount (for example, 5° F.) for a predetermined time period (for example, one hour), the adaptive subcooling algorithm increases the target subcooling number by one. The increase in $T_{TAR\text{-}DEL}$ tends to reduce $T_{LIQUID}$ such that the difference between $T_{LIQUID}$ and $T_{AMBIENT}$ is within the acceptable range (5° F.). The new higher $T_{TAR\text{-}DEL}$ reduces $T_{LIQUID}$ because it corresponds to a greater quantity of liquid refrigerant within condenser 14 which results in more efficient cooling of that refrigerant. Controller card 18 continues to compare $T_{LIQUID}$ to $T_{AMBIENT}$ and if, after another predetermined time, $T_{LIQUID}$ does not fall to within the acceptable limit, controller card 18 again increases $T_{TAR\text{-}DEL}$ by one. The $T_{TAR\text{-}DEL}$ value is decreased by controller card 18 whenever the value has not been increased for a sufficiently long period of time. When $T_{LIQUID}$ has substantially remained to within 5° F. of $T_{AMBIENT}$ (at least as averaged over a number of hours) for a twenty-four hour period, for example, the adaptive subcooling algorithm reduces $T_{TAR\text{-}DEL}$ by one degree.

In yet another embodiment, temperature sensor 42 measures the refrigerant temperature adjacent refrigeration cases 20 ($T_{CASE}$)° Controller card 18 uses $T_{CASE}$ to determine the $T_{OP}$ required to maintain a solid column of liquid to expansion valves 38 at refrigeration cases 20. Controller 18 reads $T_{CASE}$ and calculates the minimum $T_{COND}$ based upon the difference in elevation between condenser 14 and cases 20 (as input by the operator) and the probable pressure drop in the liquid line. By monitoring refrigerant temperature at cases 20, system 10 avoids the potential for a loss of refrigeration due to poor valve operation caused by vapor in the liquid refrigerant delivered by condenser 14.

As an additional feature of the present invention, controller card 18 stores the time lapse between valve operations. This time lapse typically does not exceed one hour because liquid bleed circuit 50 normally provides enough refrigerant to condenser 14 within a one hour period to increase the condenser pressure to a level corresponding to a $T_{DEL}$ greater than the $T_{TAR\text{-}DEL}$. During leak conditions, the refrigerant continuously delivered to condenser 14 is depleted from system 10 through the leak. Eventually, liquid bleed circuit 50 cannot bleed enough refrigerant to the system to cause a pressure build up in condenser 14 sufficient to drive $T_{DEL}$ above the amount required for valve operation. The system software interprets a time lapse between valve operations in excess of a maximum limit (for example, three hours) as a low charge condition. An alarm is activated to alert an operator that the system is low on charge and probably has a leak.

A system which did not monitor elapsed time between valve operations would likely continue to leak refrigerant to the atmosphere beyond the maximum limit time period. A conventional system may not detect a leak until the amount of refrigerant lost from the system was sufficient to cause inadequate refrigeration at the cases. By detecting leak conditions within the maximum limit time period, the present invention reduces the amount of product lost to poor refrigeration and may decrease the undesirable effects of refrigerant released into the environment.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A system for controlling the circulation of refrigerant through a refrigeration loop including an interconnected condenser and compressor to maintain a desired amount of subcooling of the refrigerant at the output of said condenser, said system comprising:

a receiver for containing refrigerant connected between said condenser and said compressor;

means operably associated with said loop for providing a temperature differential between said refrigerant at the output of said condenser and the phase change temperature of said refrigerant within said condenser;

said receiver connected to said loop by a valve for bleeding refrigerant from said receiver to said loop to increase said temperature differential as the volume of liquid refrigerant within said condenser increases; and controller means for diverting refrigerant from said condenser to said receiver when said temperature differential exceeds a predetermined value.

2. A system according to claim 1 wherein said controller means includes a first valve connected between said condenser output and said receiver, and a second valve connected between said receiver and said compressor, said controller means opening both of said first and said second valves when said temperature differential exceeds said predetermined value.

3. A system according to claim 2 wherein said receiver includes a lower liquid storing volume and an upper vapor storing volume, said first valve constituting means for communicating refrigerant from said condenser to said liquid storing volume and said second valve constituting means for communicating refrigerant from said vapor storing volume to said compressor.

4. A system according to claim 1 wherein said condenser is disposed at a first elevation and said receiver is disposed at a second elevation, said condenser output being connected to said receiver through an output line, said first mentioned means including (a) a temperature sensor operably associated with said output line for providing a signal to said controller means representing the temperature of the refrigerant at said condenser output and (b) a pressure sensor operably associated with said output line adjacent said receiver for providing a signal to said controller means representing the pressure of the refrigerant within said output line, said controller means deriving said refrigerant phase change temperature from said pressure signal.

5. A system according to claim 4 wherein said controller means includes means for inputting the difference in elevation between said temperature sensor and said pressure sensor, said controller means deriving said phase change temperature from said pressure signal using said difference.

6. A system according to claim 4 wherein said controller means includes a microcontroller.

7. A system according to claim 1 further comprising an expansion device in flow communication with said receiver and an evaporator coil connected between said expansion device and said compressor input, said expansion device constituting means for communicating refrigerant from said receiver to said evaporator coil wherein the refrigerant is converted to vapor.

8. A system according to claim 1 further comprising an alarm for indicating a low refrigerant charge condition, said controller means activating said alarm when the elapsed time following a said diversion of refrigerant to said receiver exceeds a predetermined maximum value before a subsequent such diversion occurs.

9. A system according to claim 1 wherein said condenser is adapted for exposure to outdoor ambient temperature, said system further comprising means for generating a signal representing said outdoor ambient temperature, said sensing means further sensing the temperature of the refrigerant at said condenser output, said controller means increasing said predetermined value when the average difference between said condenser output refrigerant temperature and said outdoor ambient temperature is greater than a second predetermined value for a first time period, said controller means decreasing said first mentioned value when said first mentioned predetermined value has remained unchanged for a second time period, said second time period being longer than said first time period.

10. A refrigeration system for optimizing refrigerant subcooling in response to changes in ambient temperature, said system comprising:

a condenser exposed to said ambient temperature having an output;

a compressor having an input and an output, said compressor output being connected to said condenser;

an expansion valve connected between said condenser output and said compressor input;

a receiver connected between said condenser output and said compressor input;

a circuit connected between said receiver and said compressor for bleeding refrigerant from said receiver into said compressor input thereby increasing the volume of liquid refrigerant within said condenser;

a sensor for measuring the refrigerant pressure within said condenser;

a sensor for measuring the refrigerant temperature at said condenser output;

a sensor for measuring said ambient temperature; and controller means responsive to said sensors for diverting refrigerant from said condenser to said receiver, said controller means calculating the phase change temperature of refrigerant within said condenser corresponding to said refrigerant pressure, diverting refrigerant from said condenser to said receiver when the temperature difference between said refrigerant temperature and said phase change temperature exceeds a value constituting the target subcooling, increasing said target subcooling value when the average difference between said refrigerant temperature and said ambient temperature is greater than a predetermined value for a first operating time period, and further decreasing said target subcooling value when said target subcooling value has remained unchanged for a second operating time period, said second operating time period being longer than said first operating time period.

11. A refrigeration system according to claim 10 wherein said receiver includes a lower liquid refrigerant storing volume and an upper vapor refrigerant storing volume, a first valve being connected between said condenser output and said receiver at its said liquid refrigerant storing volume and a second valve connected between said receiver at its said vapor refrigerant storing volume and said compressor input, said controller means opening both of said valves when said temperature difference exceeds said target subcooling value.

12. A refrigeration system according to claim 11 wherein said refrigerant pressure sensor is operably associated with said condenser output adjacent said bleed valve, said controller means including means for inputting the difference in elevation between said refrigerant pressure sensor and said refrigerant temperature sensor, said controller means calculating said phase change temperature from said refrigerant pressure using said difference.

13. A refrigeration system according to claim 10 wherein said controller means includes a microcontroller.

14. A refrigeration system according to claim 10 wherein said circuit includes an expansion device in flow communication with said receiver and an evaporator coil connected between said expansion device and the compressor input, said expansion device communicating refrigerant from said receiver to said evaporator coil wherein the refrigerant is converted to vapor.

15. A system according to claim 10 further comprising an alarm for indicating a low charge condition, said controller means activating said alarm when the elapsed time following a diversion of refrigerant to said receiver exceeds a predetermined maximum value before a subsequent diversion occurs.

16. A control system for a closed refrigeration loop including an interconnected condenser and compressor, said system comprising:

fan means mounted adjacent said condenser for creating a stream of air, said condenser being mounted within said stream, said fan means including a plurality of fans;

a receiver connected between said condenser and said compressor for collecting refrigerant;

sensing means operably associated with said loop for sensing the refrigerant temperature at the output of said condenser, the refrigerant phase change temperature within said condenser, and the outdoor ambient air temperature adjacent said condenser;

means connected to said receiver for bleeding refrigerant from said receiver into said refrigeration loop thereby increasing the temperature difference between said condenser output refrigerant temperature and said refrigerant phase change temperature as the volume of liquid refrigerant within said condenser increases; and controller means responsive to said sensing means for diverting refrigerant from said condenser to said receiver when said temperature difference exceeds a predetermined value, said controller means minimizing the usage of said fan means by decreasing the number of enabled fans of said fan means when the sum of said predetermined value and said air temperature is greater than said refrigerant phase change temperature, said controller means increasing said number of enabled fans when said sum plus a predetermined offset is less than said refrigerant phase change temperature.

* * * * *